US009005087B1

(12) United States Patent
Betoney, Jr.

(10) Patent No.: US 9,005,087 B1
(45) Date of Patent: Apr. 14, 2015

(54) WEIGHT LIFTING APPARATUS

(76) Inventor: Billy Betoney, Jr., Bellemont, AZ (US)

( * ) Notice: Subject to any disclaimer, the term of this patent is extended or adjusted under 35 U.S.C. 154(b) by 167 days.

(21) Appl. No.: 13/594,689

(22) Filed: Aug. 24, 2012

(51) Int. Cl.
*A63B 21/078* (2006.01)
*A63B 21/06* (2006.01)
*A63B 21/072* (2006.01)

(52) U.S. Cl.
CPC ..... *A63B 21/078* (2013.01); *A63B 2208/0223* (2013.01); *A63B 21/06* (2013.01); *A63B 21/072* (2013.01)

(58) Field of Classification Search
CPC ..... A63B 21/06; A63B 21/0611; A63B 21/0724; A63B 21/078; A63B 2021/0614; A63B 2023/0411; A63B 2208/0223
USPC ..... 482/44–50, 92, 93, 97, 98, 104, 482/106–110, 139, 140; D21/679–683
See application file for complete search history.

(56) References Cited

U.S. PATENT DOCUMENTS

| | | | | | |
|---|---|---|---|---|---|
| 2,385,315 | A | | 11/1944 | Vanasse | |
| 3,322,425 | A | * | 5/1967 | Moore | 482/105 |
| 3,370,850 | A | | 2/1968 | Moore | |
| 4,274,628 | A | * | 6/1981 | Hoagland | 482/106 |
| D262,814 | S | * | 1/1982 | Lambert et al. | D21/694 |
| 4,429,870 | A | | 2/1984 | Gibbs et al. | |
| 4,605,222 | A | | 8/1986 | Shannon | |
| 4,720,096 | A | * | 1/1988 | Rogers | 482/106 |
| 4,765,612 | A | | 8/1988 | Henry, Jr. | |
| 4,789,154 | A | | 12/1988 | Mattox | |
| 4,832,334 | A | | 5/1989 | Mullen | |
| 4,863,158 | A | * | 9/1989 | Tassone | 482/140 |
| 4,986,536 | A | | 1/1991 | Zane | |
| D320,636 | S | | 10/1991 | Eckler | |
| D327,927 | S | * | 7/1992 | Foley | D21/681 |
| 5,569,133 | A | | 10/1996 | Vittone | |
| 5,591,109 | A | * | 1/1997 | Strnad | 482/107 |
| 5,725,461 | A | | 3/1998 | Bogard | |
| 5,957,818 | A | * | 9/1999 | Betournay | 482/105 |
| D425,151 | S | | 5/2000 | Landfair | |
| D447,779 | S | | 9/2001 | Munger | |
| 6,432,029 | B1 | * | 8/2002 | Almeda | 482/140 |
| D464,691 | S | | 10/2002 | Tracy | |
| 6,652,431 | B1 | * | 11/2003 | Mattox | 482/139 |
| 7,112,164 | B1 | | 9/2006 | Hoagland | |
| D685,865 | S | * | 7/2013 | Kuhn | D21/679 |
| 2006/0040802 | A1 | * | 2/2006 | Vittone et al. | 482/106 |
| 2006/0100075 | A1 | | 5/2006 | Harsh | |
| 2007/0072750 | A1 | * | 3/2007 | Andrews | 482/104 |
| 2010/0056347 | A1 | | 3/2010 | Summers | |

* cited by examiner

*Primary Examiner* — Steve R Crow
*Assistant Examiner* — Gregory Winter
(74) *Attorney, Agent, or Firm* — Invention To Patent Services; Alex Hobson

(57) ABSTRACT

A weight lifting apparatus having a weight lifting bar, and in some cases, a weight lifting stand configured to support the weight lifting bar, is described. The weight lifting bar is a linearly contiguous bar having a neck wrap portion, two elongated members extending down approximately an arm's length from the neck wrap portion to at least the waist of a lifter and weight posts. Linearly contiguous means that the primary bar components, including the neck warp portion, elongated members and weight posts, are all part of a single connected bar having a length and a first end and second end. The weight lifting apparatus may comprise a stand configured to support the weight lifting bar. A stand may comprise a main portion, a step-up platform and a weight lifting bar support comprising two support members extending from the main portion or the step-up platform, and a bar rest.

11 Claims, 13 Drawing Sheets

WEIGHT LIFTING APPARATUS

BACKGROUND OF THE INVENTION

1. Field of the Invention

The present invention relates to a weight lifting apparatus comprising a weight lifting bar, and in another embodiment a weight lifting bar and a stand.

2. Background

Leg based weight lifting motions, including squats, lunges and calf raises can be cumbersome, difficult and dangerous when standard free weight equipment is used. Typically, a straight weight lifting bar is used for squats and calf raises. The bar is usually on a rack requiring a lifter to position the bar behind their neck and secure the bar with their hand in a very awkward position. The lifter then steps backward and away from the rack to provide enough room to perform the lifting motion. This is dangerous, as the lifter is stepping backward with a heavy load positioned on their shoulders. In addition, with the weight positioned over the lifters shoulders, any bend of the torso puts a great load on the lifters lower back. Furthermore, when the lifter is done with their set, they have to step back toward the rack and precisely set the bar on pegs to secure the bar. If the lifter tires during a repetition, "rep", and cannot complete the squat, there is no safe and easy way to remove the bar from their shoulders. Many weight lifters do squats with a high weight to fully stress their lower body muscles including their quadriceps, hamstrings, calves, and gluteus maximus for example. Unfortunately, many lifters cut their squats short, not because of tiring leg muscles, but because the heavy weight on their shoulders becomes painful, or their lower back is strained from the position of the heavy weight over their shoulders.

When a weight lifter performs a lunge, they typically use a bar across the shoulders and behind the neck as described for the squat exercise, or they hold dumbells. A lunge motion may put even more strain on the lower back when the weight is positioned over the shoulders. When dumbells are used, they typically are difficult to hold for long periods of time as the hand, wrist, forearms and shoulder become taxed. In addition, dumbells often bang into the lifters legs and particularly their knees when performing lunges.

There exists a need for a weight lifting apparatus comprising a bar that is configured for easy and safe support by the lifter and that is easy and safe to lift from and return to a rack.

SUMMARY OF THE INVENTION

The invention is directed to a weight lifting apparatus comprising a weight lifting bar, and in some embodiments, a weight lifting stand configured to support the weight lifting bar. The weight lifting bar, as described herein, comprises a linearly contiguous bar comprising a neck wrap portion, two elongated members extending from the neck wrap portion down to at least the waist of an appropriately sized person that is standing upright, and weight posts for placement of weights, for example. In one embodiment, the linearly contiguous weight lifting bar comprises a neck wrap portion that wraps around the back of a person's neck and then transitions to elongated members that extend down over a person's torso and outwardly to the outside of the person's waist. The weight lifting bar described herein may have any suitable shape and curvature. In one embodiment, the elongated members extend down and also flare outward from the transition with the neck wrap portion and then extend generally linearly to the weight posts. Linearly contiguous, as used herein, means that the primary bar components, including the neck wrap portion, elongated members and weight posts, are all part of a single connected bar having a length and a first end and second end. In one embodiment, the weight lifting bar consists essentially of a linearly contiguous bar, meaning that the bar has no additional support members or attachments connecting one portion of the linear contiguous bar with a second portion of the linear contiguous bar; such as a member that extends from a first elongated member directly across to a second elongated member. In another embodiment, the weight lifting bar consists essentially of a single integral bar, whereby the primary bar components consist of a single, permanently connected bar. In one embodiment, a weight bar consisting essentially of a single integral bar is formed from a single bar that has been shaped to comprise a neck wrap portion, two elongated members and weight posts as described herein. In another embodiment, a weight bar consisting essentially of a single integral bar is formed from a plurality of bar components that are permanently attached, such as by welding, to form the single integral bar.

The weight lifting bar, described herein, may be made out of any suitable material including, but not limited to, metal, composites, plastic, rubber and the like. In an exemplary embodiment, the weight lifting bar is made out of a single shaped piece of metal. The weight lifting bar may have any suitable cross-sectional shape including round, square, rectangular, polygonal and the like. In an exemplary embodiment, the weight lifting bar has a round cross section and is a solid rod of metal. The weight lifting bar may be hollow or solid, or any portion thereof may be hollow or solid. The weight lifting bar may be rubber and configured for use in a pool, whereby suitable weights may be added for water aerobic activities and the like.

In one embodiment, the weight lifting bar is configured in discrete components, whereby portions of the weight lifting bar can be attached to other components of the weight lifting bar. For example, the neck wrap portion may be configured to attach to the elongated members. Likewise, the weight posts or handles may be discrete components and configured to be attached to an elongated member and/or the weight posts, as appropriate. Detachably attachable weight lifting components allow for more compact packing and shipping of a weight lifting bar as described herein. Any suitable attachments may be used. In one embodiment, one discrete weight lifting component comprises a threaded end, and another weight lifting component comprises a matching female threaded portion. Alternatively, an insert and twist locking mechanism may also be used for discrete components, wherein one component is inserted into a cavity of a second component and then twisted to lock the two discrete components together.

The weight lifting bar, as described herein, comprises weight posts configured for the placement of weights or the attachment of resistance bands. The weight posts may be configured to have a diameter to accommodate standard free weight plates for example. In addition the posts may be configured to accept a collar to secure the weights in place. In another embodiment, the weight posts are configured to accept one end of a resistance band, wherein the other end of the resistance band may be secured to the weight lifting stand as described herein, for example.

The weight lifting bar, as described herein, may further comprise handles. Handles may be helpful to alleviate strain on a lifters neck and shoulders by providing them with the capability to easily lift or reduce the weight bearing on their neck and shoulders. Since the elongated members are generally configured to extend down beyond a lifter's waist, the handles may be configured in an ergonomic position for lifting. The elongated members are configured to extend approximately a lifter's arm's length. Handles may simply be the weight posts or attachable handles that may be attached to the weight posts, such as collar handles. For example, a lifter may place weights onto the weight posts and then slide a collar over the weight posts to secure the weights in place. This collar may have a locking feature to secure the collar from sliding off the weight posts and prevent the collar handle from rotating. For example, the locking feature may comprise a rotational lock, such as a key, to prevent the collar from rotating. Furthermore, the handle may have a hand-grip portion, such as a contoured outer surface, of a loop configured for gripping. In another embodiment, handles are configured inside of the weight posts and may be essentially perpendicular to the length axis of the weight posts. For example, handles may be back facing handles that extend in a backward direction from the weight posts.

The weight lifting bar, as described herein, may further comprise one or more padding sleeves. A padding sleeve may substantially surround the weight lifting bar and may comprise any suitable material including, but not limited to, foam, rubber, fabric, composites, or any other suitable material. In one embodiment, the padding sleeve covers the neck wrap portion of the weight lifting bar. In another embodiment, the padding sleeve extends over a substantial portion of the elongated members, such as over at least fifty percent of the length of the elongated member, $EM_L$.

The weight lifting apparatus, as described herein, may comprise a stand configured to support the weight lifting bar as described herein. A stand may comprise a step-up platform and a weight lifting bar support comprising two support members extending from the step-up platform and a bar rest. The stand may be configured to allow a person to load weights onto the weight posts while the weight lifting bar is positioned in the stand. Furthermore, the stand may be configured to allow a person to step into an open area between the two support members and pivot the neck wrap portion of the weight lifting bar around their neck.

The stand, as described herein, may further comprise a calf-raise portion, whereby a lifter may rotate the neck wrap portion of the weight lifting bar over their neck and then simply lift the bar and step onto the calf-raise portion of the stand. The calf-raise portion may be configured between the two support member and in front of the step-up platform.

The stand, as described herein, may further comprise support handles whereby a lifter may hold onto the support handles when performing squats, step-up exercises, or calf raises. The support handles may be coupled to the bar rest, and may extend outward or forward toward the support members.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
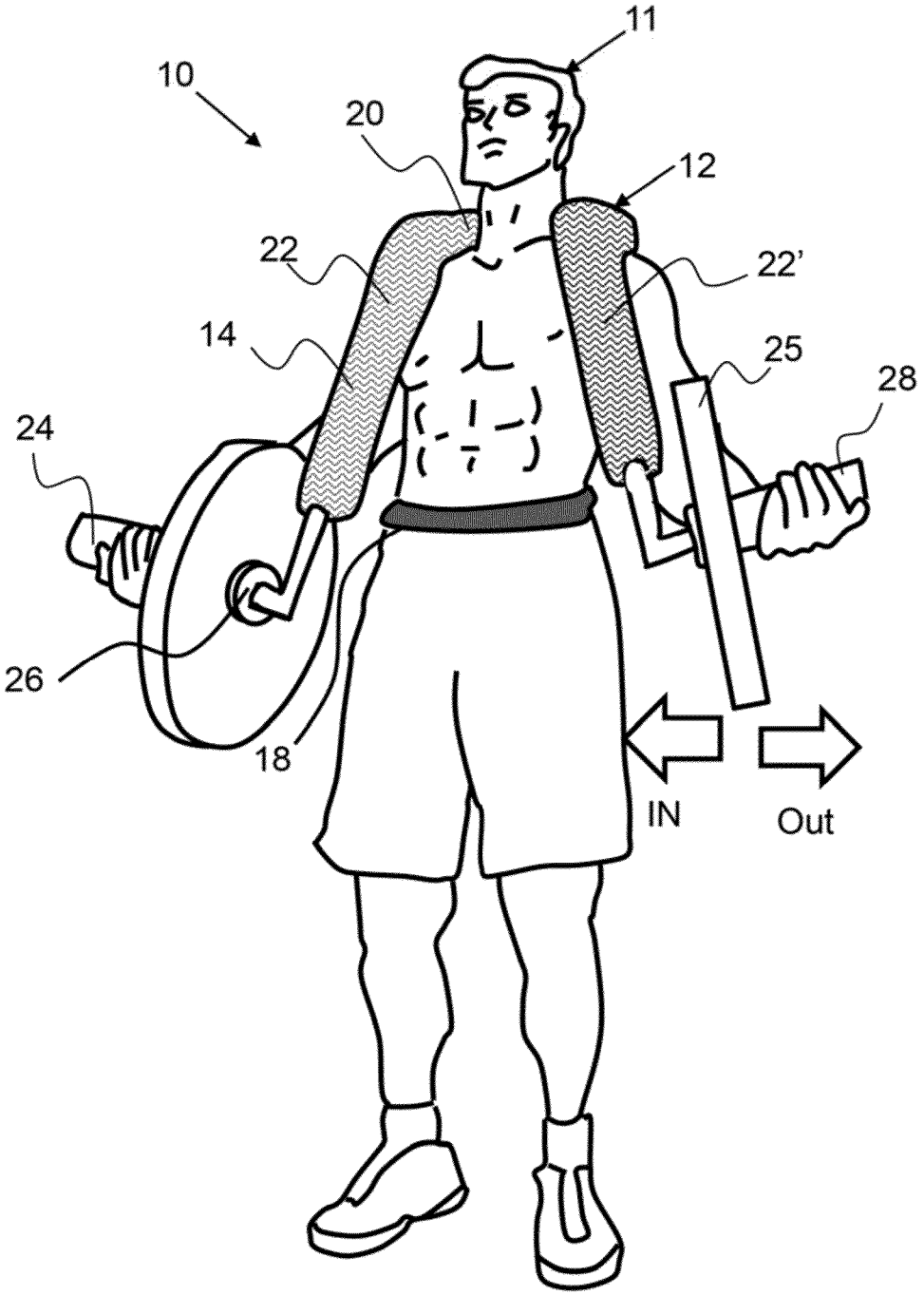

FIG. 1 shows an exemplary weight lifting bar held by a lifter as described herein.

Figure 2:
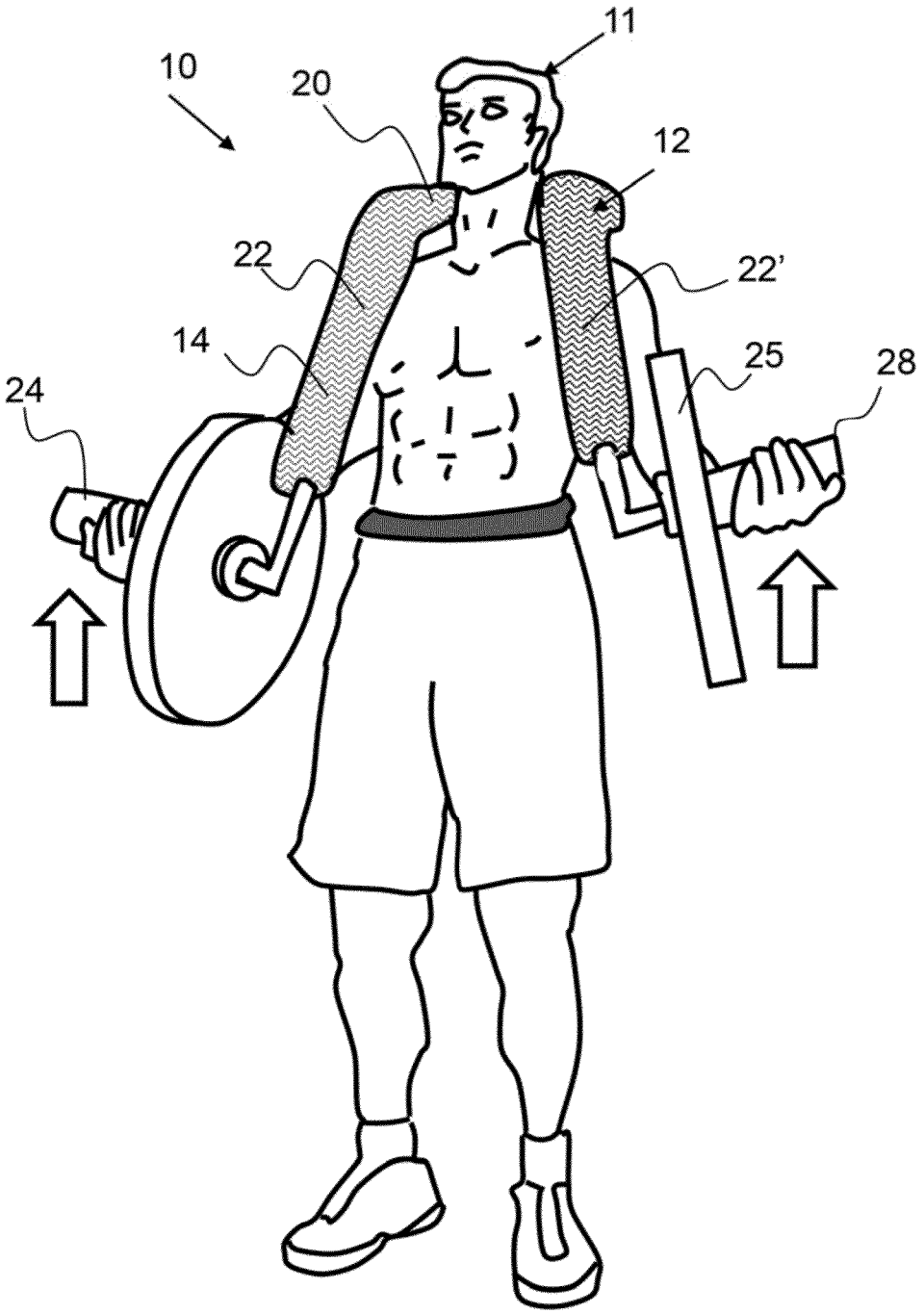

FIG. 2 shows an exemplary weight lifting bar held by a lifter as described herein.

Figure 3A:
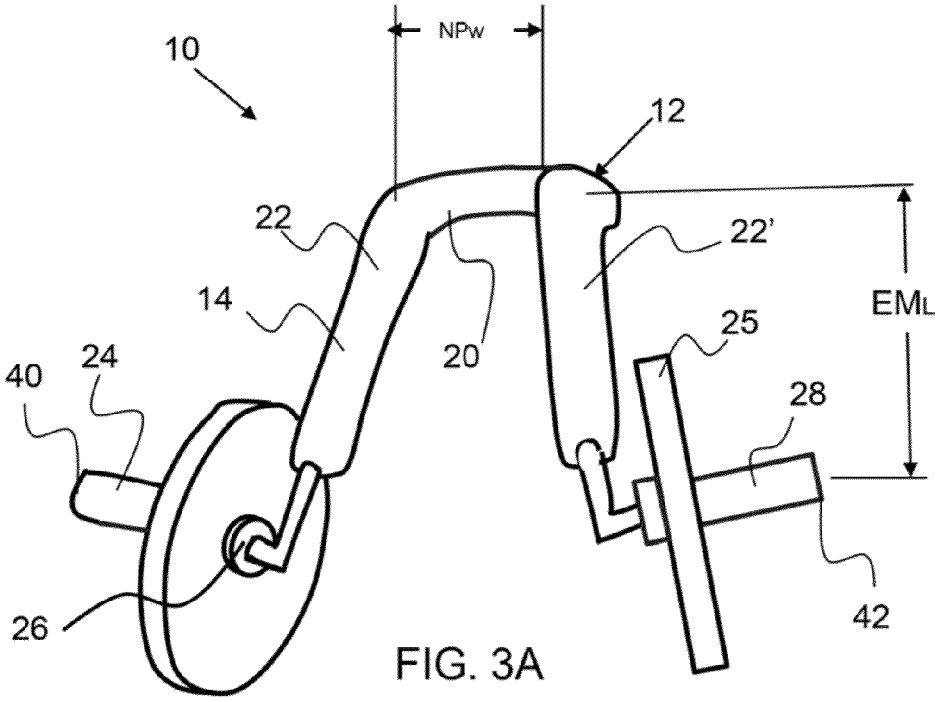

FIG. 3A shows an isometric view of an exemplary weight lifting bar as described herein.

Figure 3B:
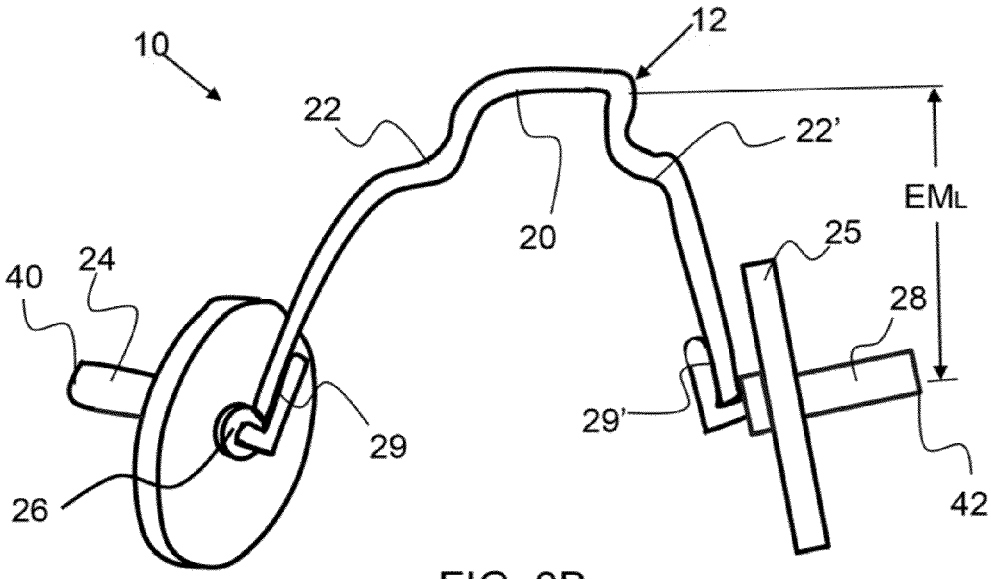

FIG. 3B shows an isometric view of an exemplary weight lifting bar as described herein.

Figure 4:
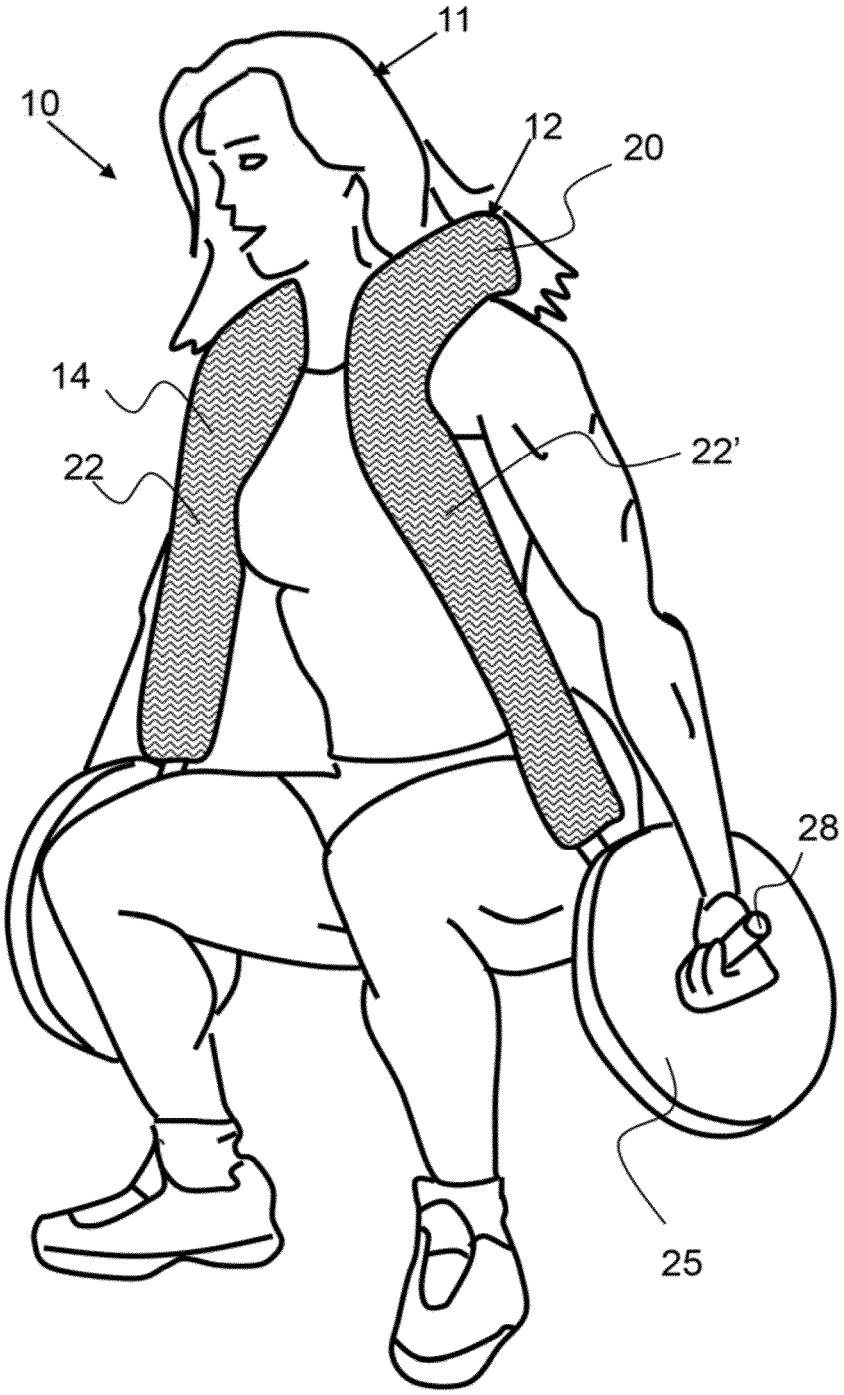

FIG. 4 shows an exemplary weight lifting bar held by a lifter in a squat position as described herein.

Figure 5A:
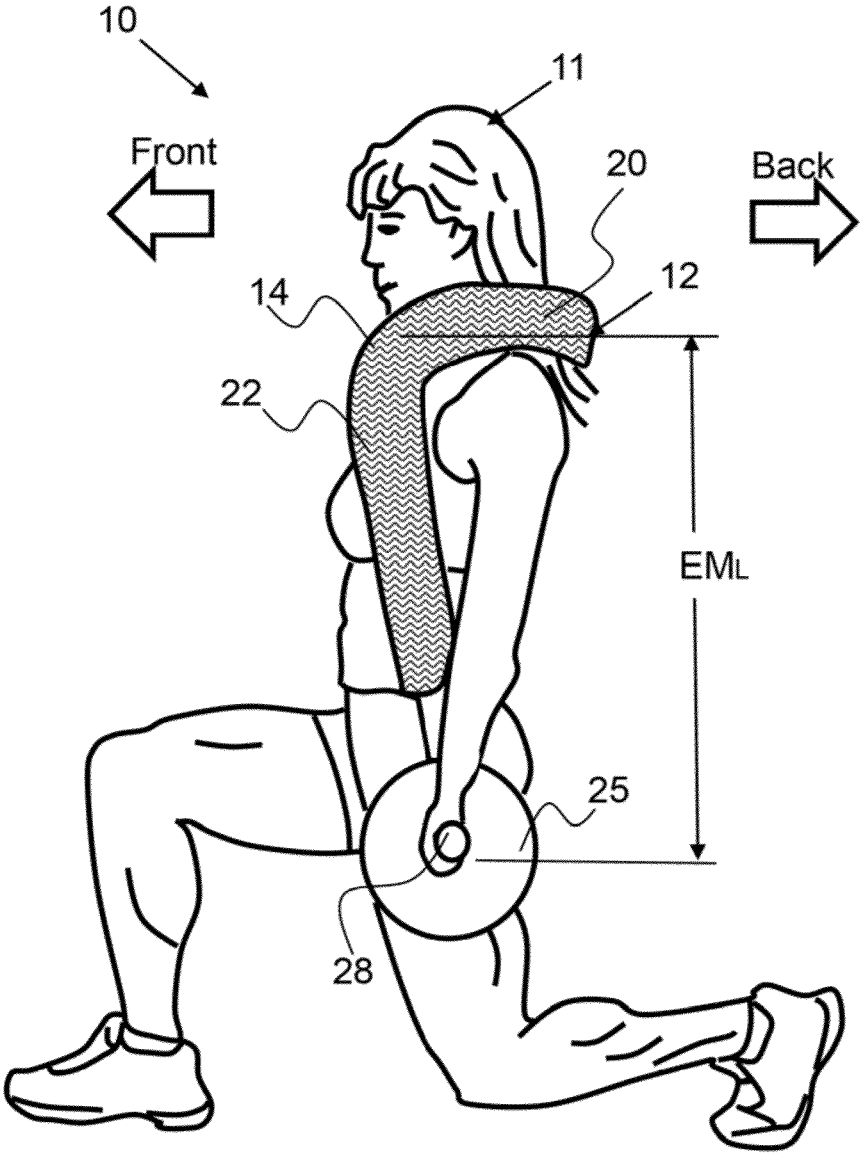

FIG. 5A shows an exemplary weight lifting bar held by a lifter in a lunge position as described herein.

Figure 5B:
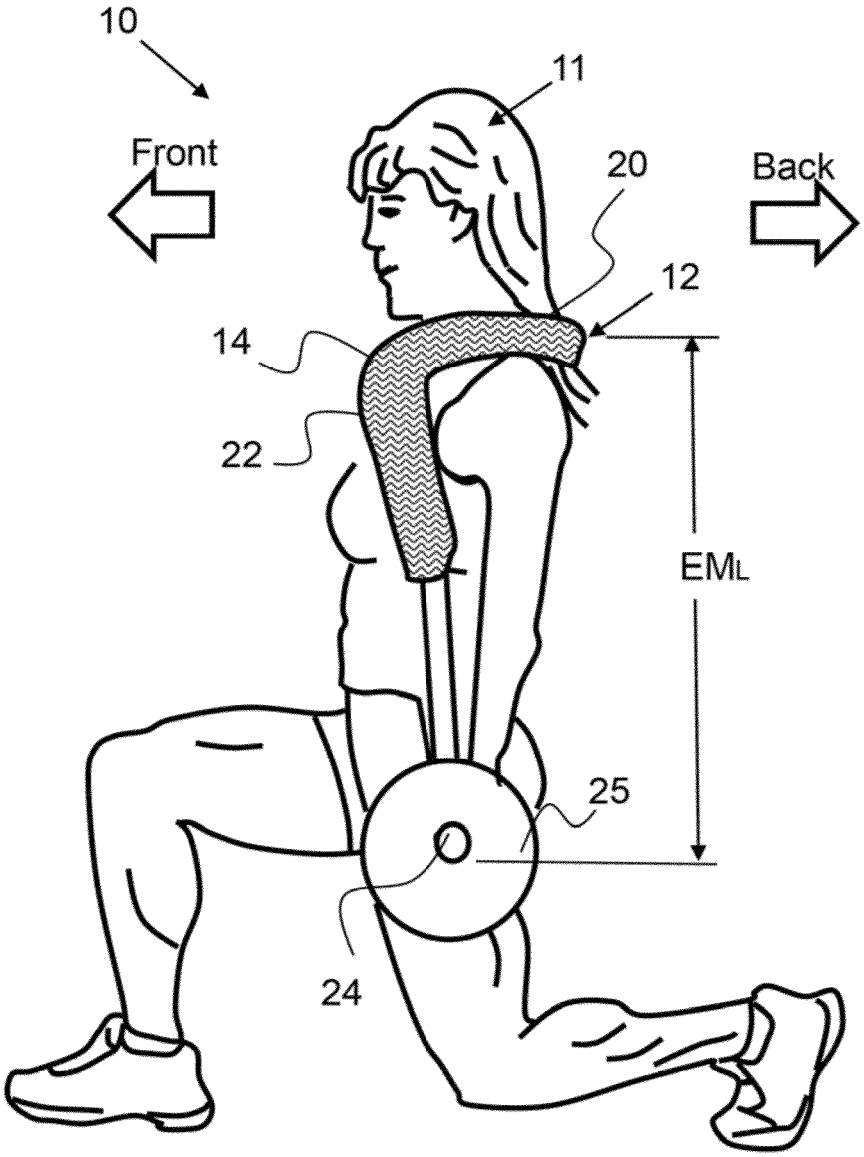

FIG. 5B shows an exemplary weight lifting bar held by a lifter in a lunge position as described herein.

Figure 6A:
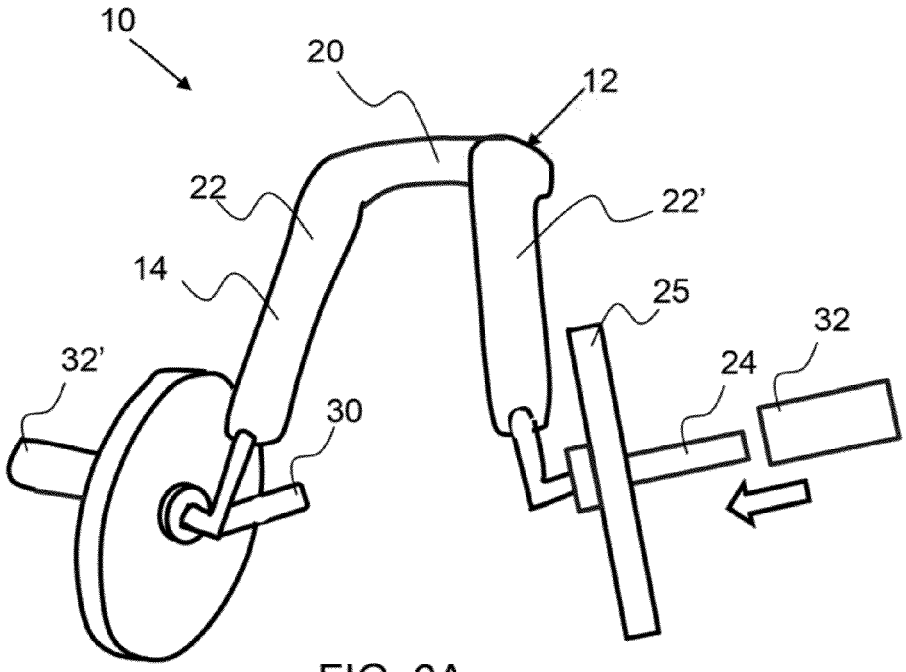

FIG. 6A shows an isometric view of an exemplary weight lifting bar having handles as described herein.

Figure 6B:
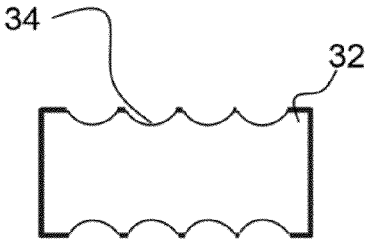

FIG. 6B shows front view of an exemplary collar type handle having a grip portion as described herein.

Figure 6C:
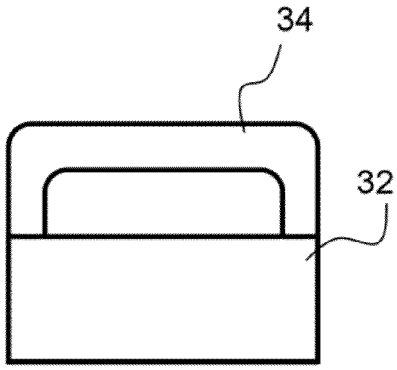

FIG. 6C shows front view of an exemplary collar type handle having a loop type grip portion as described herein.

Figure 7:
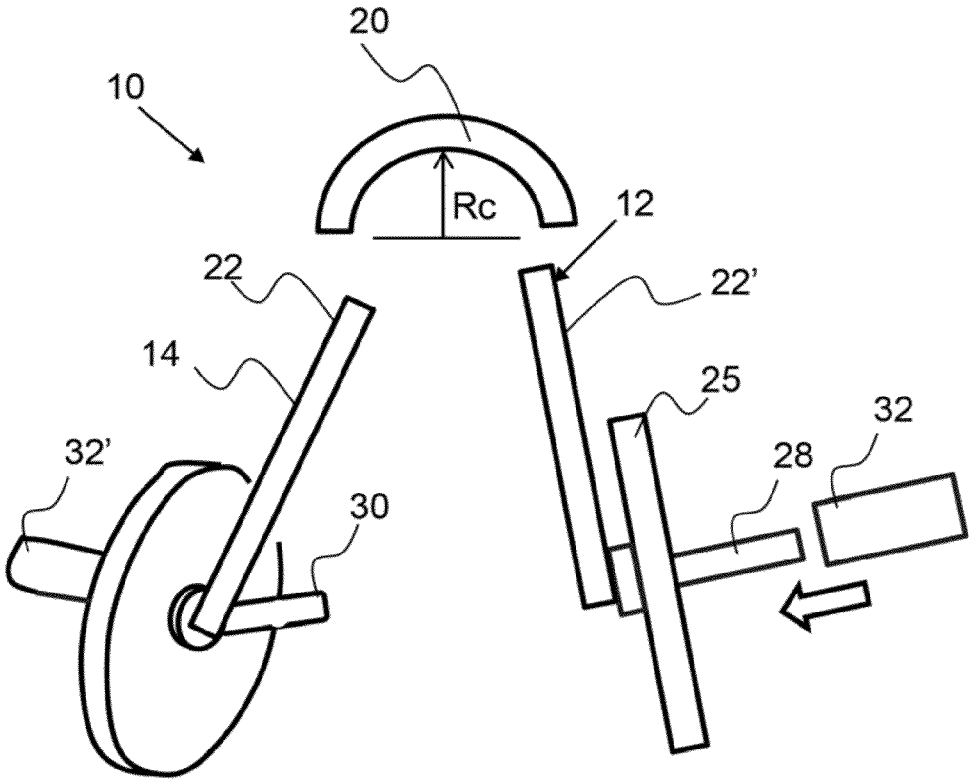

FIG. 7 shows an isometric view of an exemplary weight lifting bar as described herein.

Figure 8:
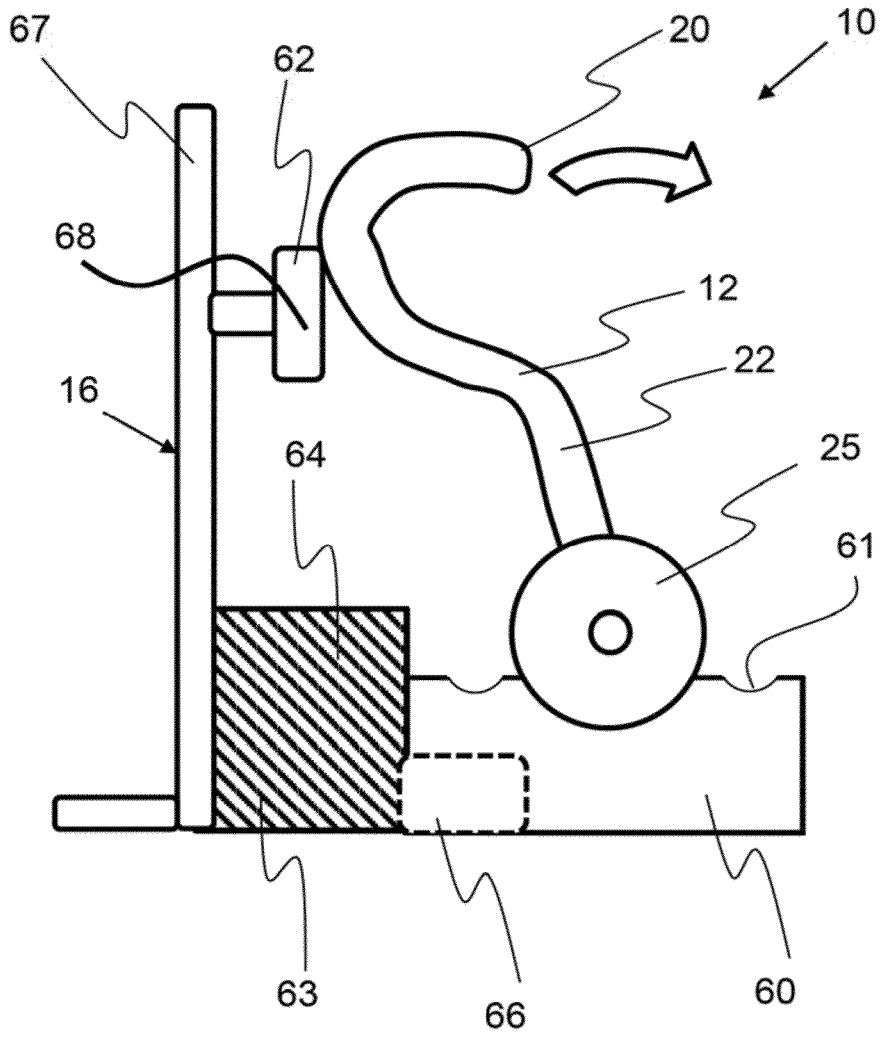

FIG. 8 shows a side view of an exemplary weight lifting apparatus having a stand and weight lifting bar as described herein.

Figure 9:
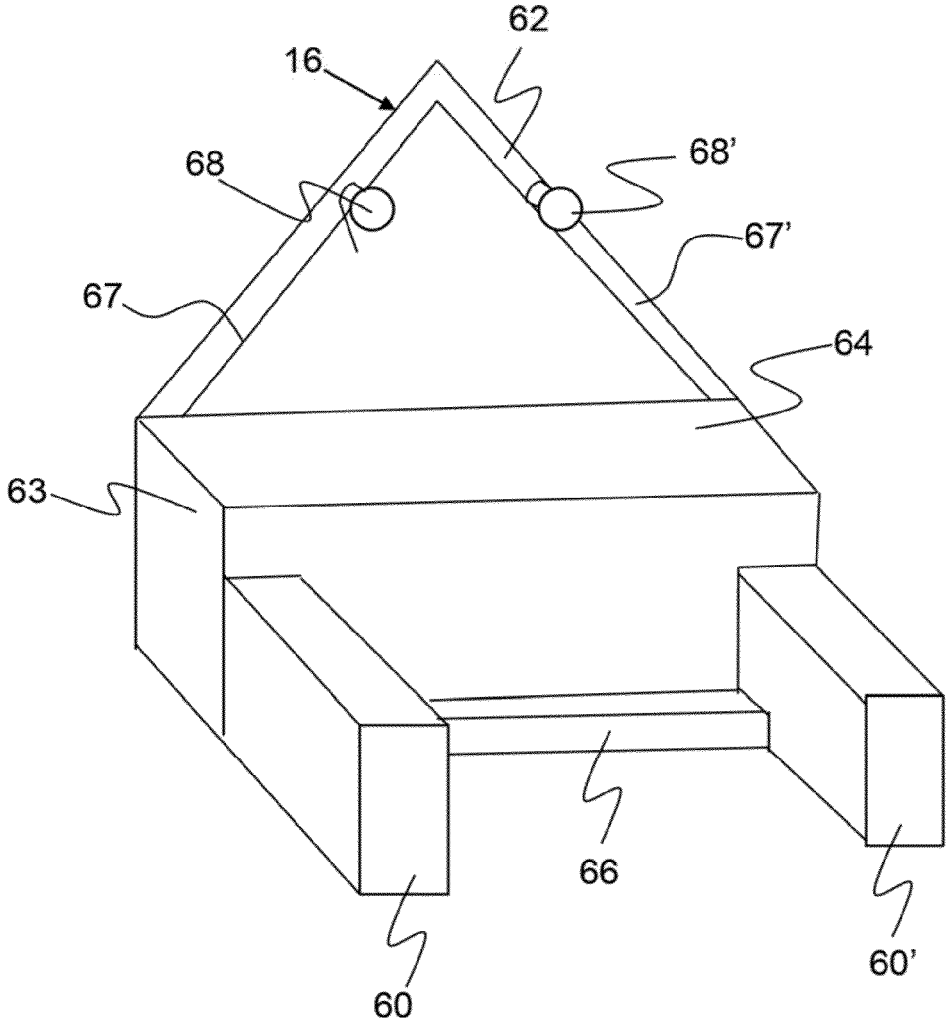

FIG. 9 shows isometric view of an exemplary weight lifting apparatus having a stand and weight lifting bar as described herein.

Figure 10:
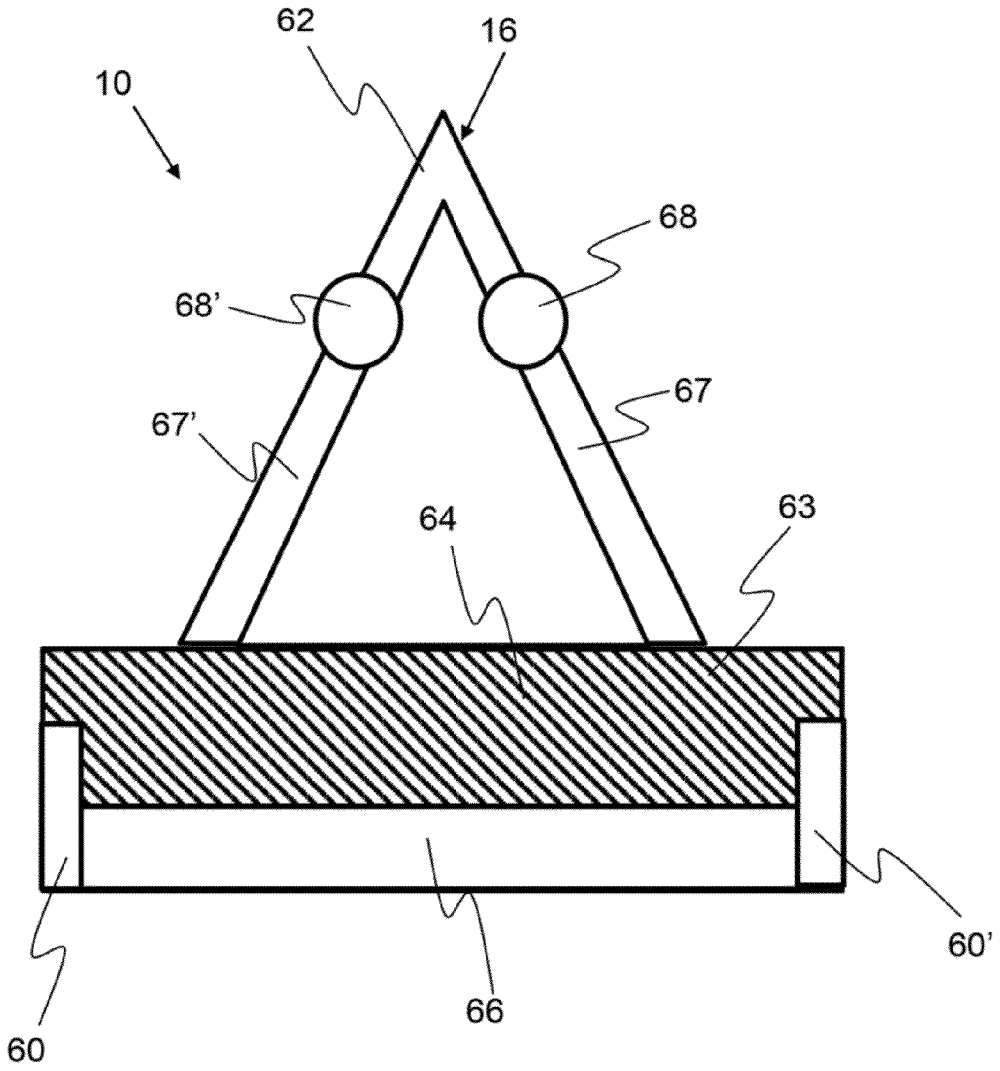

FIG. 10 shows a front view of an exemplary weight lifting apparatus as described herein.

Figure 11:
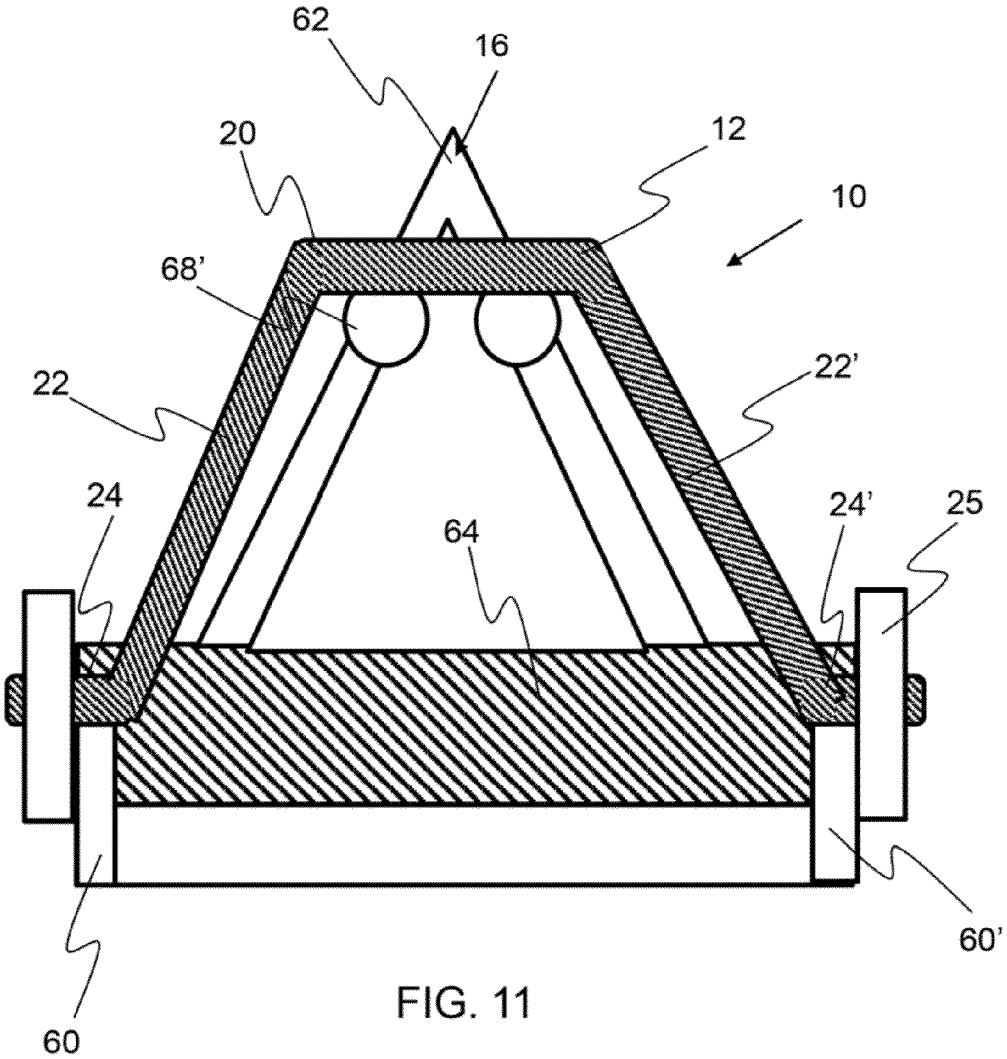

FIG. 11 shows a front view of an exemplary weight lifting apparatus having a stand and weight lifting bar as described herein.

Figure 12:
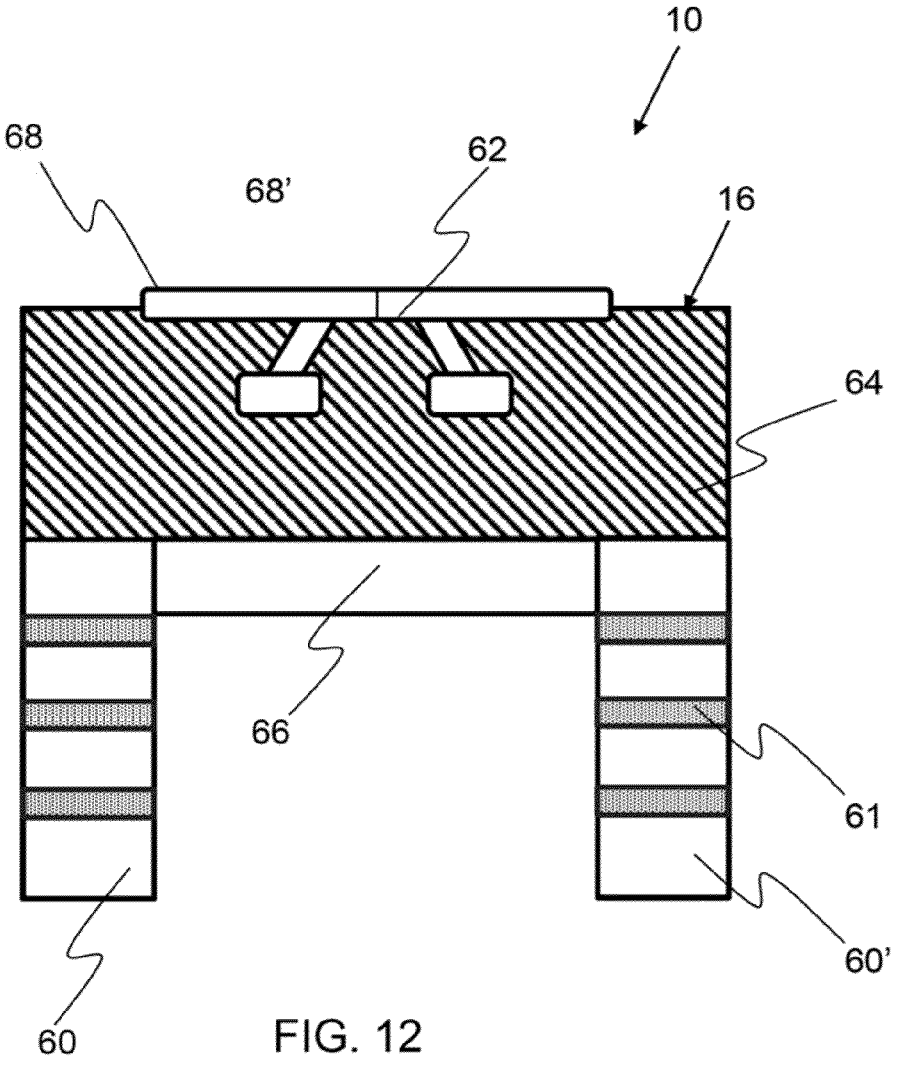

FIG. 12 shows a top-down view of an exemplary weight lifting apparatus as described herein.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular, and also includes the plural unless it is obvious that it is meant otherwise.

Certain exemplary embodiments of the present invention are described herein and illustrated in the accompanying figures. The embodiments described are only for the purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

Definitions

Elongated member, as used herein, is defined as a portion of the weight lifting bar that extends from the neck wrap portion to at least an appropriately sized lifter's waist and has a length to a maximum cross-sectional dimension ratio of four or more, eight or more, ten or more, twenty or more, or any range between and including the ratios provided. Maximum cross-sectional dimension as used herein means the maximum distance across the elongated member taken across the length dimension of the elongated member. For example, if the elongated member is a round bar, the cross-section will be a circle and the maximum cross-sectional dimension is the outer diameter of the round bar.

Appropriately sized person or lifter as described herein refers to a person that is appropriately sized for a given weight lifting bar as described herein, whereby the bar fits the person as generally shown in FIG. 1, 2, 4 and FIG. 5, whereby the elongated members extend approximately arm's length and down to at least the lifters waist. The weight lifting bar, as described herein, may come in a number of sizes to accommodate different lifter sizes.

Arm's length, as used herein, is a length of at least about 40 cm, at least about 50 cm, at least about 60 cm, at least about 75 cm, and any range between and including the length values listed.

FIG. 1 shows an exemplary weight lifting bar 12 held by a lifter 11 having weight 25 on the weight posts 24. The neck wrap portion 20 is positioned around the lifters neck and rests on the lifter's shoulders, and the first and second elongated members 22, 22' extend down beyond the lifter's waist. The neck wrap portion as shown in FIG. 1 and FIG. 2 is configured with a curved portion that wraps around the back of a lifters neck. The curved portion of the neck wrap portion may have any suitable radius of curvature, Rc, as shown in FIG. 7, including, but not limited to, no more than 25 cm, no more than 20 cm, no more than 15 cm no more than 10 cm, and any range between and including the radius of curvature values listed. The neck wrap portion 20 extends over a lifter's shoulders and transitions to the elongated members that extend down. The width of the neck wrap portion, NPw, as shown in FIG. 3, where the neck wrap portion transitions to the elongated members, may be any suitable width including, but not limited to, no more than about 50 cm, no more than about 40 cm, no more than about 30 cm, no more than about 20 cm and any range between and including the NPw values listed.

Also shown in FIG. 1 and FIG. 2, are weight posts 24 that may also act as handles 28, whereby the lifter 11 can lift the weight lifting bar 12 to reduce the load and strain on his shoulders and neck, as shown in FIG. 2. The arrows shown in FIG. 2 indicate that the lifter has lifted the weight lifting bar off his shoulders. A stop 26 to prevent the weights from moving too close to the elongated member and creating a pinch point is shown in FIG. 1. A stop 26 may be a fixed element, such as a welded collar on the weight posts, or it may be adjustable along the length of the weight posts. The elongated members extend beyond, or outside of, the lifter's waist 18, as shown in FIGS. 1 and 2. The position of the weight posts below the waist of a person standing upright provides the weight posts and/or handles at approximately arm's length. This is a comfortable position for the weights, as they are positioned outside of the lifter's waist and legs, thereby allowing for a wide range of motion. Arrows showing the "in" and "out" directions, as used herein, are provided in FIG. 1 for clarity. "In" is toward the lifter's body and "Out" is away from the lifer's body. Also shown in FIG. 1 and FIG. 2 is a padding sleeve 14 that is configured over the neck wrap portion and over a substantial portion of the elongated members.

FIG. 3A shows an isometric view an exemplary weight lifting bar as described herein. As shown in FIG. 3A, the weight lifting bar is linearly contiguous, wherein the primary bar components, neck wrap portion, elongated members and weight posts, are all part of a single connected bar having a length and a first end 40 and second end 42. The length of the weight lifting bar is the distance from the first end 40 to the second end 42 traversing the curvature of the bar. In one embodiment, the weight lifting bar consists of the primary bar components and may be a single integral bar. A single integral bar may be a single piece of bar stock that has been bent or formed or otherwise configured into the weight lifting bar shape described herein. In one embodiment, as shown in FIG. 3B a single integral bar 12 comprises a plurality of discrete components that have been welded 29 or otherwise permanently attached. In yet another embodiment, the weight lifting bar comprises a plurality of detachably attachable components, as shown in FIG. 7 and described herein. The weight lifting bar shown in FIG. 3B has a flared geometry whereby the elongated members 22, 22' extend down and flare out from the transition with the neck wrap portion 20. This flared configuration may extend the weights further away from a lifter's waist and legs, thereby providing greater freedom of movement. The weight posts 24 are welded 29, to the elongated members as shown in FIG. 3B.

FIG. 4 shows an exemplary weight lifting bar 12 held by a lifter 11 in a squat position. The two elongated members 22, 22' extend down approximately arm's length and beyond the lifter's waist to provide a convenient, safe and ergonomic position to stabilize the bar. Again, the weight posts 24, not shown, or handles 28 provide the lifter with a way to reduce the strain on their neck. As shown in FIG. 4, the weights are positioned in a much more stable and safe location than a straight weight lifting bar held over a lifter's shoulders. If the lifter were to pivot their torso forward or backward when wearing the weight lifting bar as shown in FIG. 4, there would not be an additional moment force from weights positioned over their shoulders.

FIG. 5A shows an exemplary weight lifting bar 12 held by a lifter 11 in a lunge position. The weight lifting bar 12 shown in FIG. 5A does not interfere with the lunge position or motion, and the lifter is holding onto handles 28 that are configured on the outside of the weights 25. When a lifter holds dumbbells during a lunge exercise, the dumbbells are prone to hit the lifter's legs and in particular their knees. Furthermore, when a lifter holds dumbbells, there is a lot of strain on their hands, wrist, arms and shoulders. Some lifters are unable to complete their lunge exercise set because their hands, arms or shoulders tire requiring them to release the dumbbells. The weight lifting bar of the present invention provides for a more convenient means to support the weights 25 during lunges. As shown in FIG. 5A, the padding sleeve 14 extends over a substantial portion of the length of the elongated members. The length of the elongated members, $EM_L$ is shown is FIG. 5A as the length of the elongated member from the transition with the neck wrap portion, or where the bar begins to extend downward, to the weight post. The $EM_L$ may be any suitable length, but in a preferred embodiment is approximately an arm's length or at least about 40 cm, at least about 50 cm, at least about 60 cm, at least about 75 cm, and any range between and including the length values listed. The arrows shown in FIG. 5A indicate the front and back direction used herein for describing the orientation of components.

FIG. 5B shows another exemplary weight lifting bar 12 held by a lifter 11 in a lunge position. The weight lifter 11 shown in FIG. 5B is holding onto handles that are configured inside of the weights 25 and extend back from the elongated member 22. In addition, the padding sleeve 14 shown in FIG. 5B is shorter than the padding sleeve shown in FIG. 5A. The padding sleeve shown in FIG. 5B does not extend more than half the length of the elongated members 22 and therefore does not extend over a substantial portion of the elongated members.

FIG. 6A shows an isometric view of an exemplary weight lifting bar 12 having handles 32 that fit over the weight posts 24. As indicated by the arrow in FIG. 6A, the handle collar type handle 32 may be slid over or otherwise attached to the weight post. An attachable handle, such as a collar handle may be configured to secure a weight on the weight post. For example, a collar type handle may require a person to press or squeeze an engagement feature while sliding the collar handle onto the weight post. Handles 30 are configured inside of and essentially perpendicular to the weight posts 24.

FIG. 6B shows a front view of an exemplary collar type handle 32 having a grip portion 34 comprising a contoured surface for improving grip and comfort. FIG. 6C shows front view of an exemplary collar type handle 32 having a loop type grip portion 34; whereby a lifter may grip the loop and support the weight lifting bar during exercise.

FIG. 7 shows an isometric view of an exemplary weight lifting bar 12 having detachably attachable components. The neck wrap portion 20 is shown detached from the elongated members 22, 22'. This configuration may greatly improve packing of the weight lifting bar described herein and make shipping more affordable. One or more components may be configured to be detachably attachable including the neck wrap portion, the elongated members, the weight posts, the padding sleeve, the handles and the like. Any suitable means of attachment, as described herein, may be used to attach one component to another component.

FIG. 8 shows a side view of an exemplary weight lifting apparatus 10 comprising a stand 16 and weight lifting bar 12. The stand comprises a plurality of bar supports 60 configured to retain the weight lifting bar when not in use. The bar supports 60 extend from a main portion 63 having a step-up platform 64. The weight lifting bar is shown resting against the bar rest 62. A support member or members 67 may be configured to extend from the main portion 63 and the bar rest 62. In addition, support handles 68 may provide a lifter with more support and stability when exercising, such as when stepping up onto the step-up platform. Also shown in FIG. 8 is a plurality of support retainers 61, depicted as contoured portions of the bar supports 60. The support retainers 61 are configured to keep the weight lifting bar 12 from moving or sliding along the bar supports 60.

FIG. 9 shows a front isometric view of an exemplary weight lifting stand 16. This view clearly shows how the bar supports 60, 60' extend from the main portion 63, and how the calf-raise portion 66 is disposed therebetween. The bars supports 60, 60' may be any suitable height or width, and may comprise one or more bars type supports or a block of material as shown in FIG. 9. The support handles 68, 68' are shown attached to the support members 67, 67'. The weight lifting bar may be configured to rest on a support member or support handle. A stand, as described herein, may have any suitable configuration of handles. For example the stand may have looped type handles whereby a person can grip around the loop. The handles shown in FIG. 9 are knob type handles.

FIG. 10 shows a front view of an exemplary stand 16, shown in FIG. 8. The two bar supports 60, 60' are shown on either side of the main portion 63, and the calf-raise portion 66 is shown disposed therebetween. Two support member 67, 67' are shown extending from the main portion 63 and have support handles 68, 68' attached thereto. Any suitable configuration of the support member 67 may be used, such as a plate, or single support member, for example.

FIG. 11 shows a front view of an exemplary stand 16, shown in FIG. 10, having a weight lifting bar 12 disposed thereon. The weight lifting bar 12 is supported by the bar supports 60, 60' along the weight posts 24, 24', respectively.

FIG. 12 shows a top-down view of an exemplary weight lifting stand 16, shown in FIGS. 8, 9 and 10. The two bar supports 60, 60' are shown extending from the main portion 63, and have a plurality of support retainers 61 for positive placement of the weight lifting bar described herein (not shown).

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A weight lifting apparatus comprising:
a weight lifting bar comprising:
a neck wrap portion;
two elongated members extending down from the neck wrap portion;
weight posts;
a first end; and
a second end;
wherein the weight lifting bar is linearly contiguous between the first end and the second end, wherein the two elongated members extend vertically down from the neck wrap portion to at least a waist level of a user when the neck wrap portion is positioned around the back of the user's neck and the user is in an upright standing position;
wherein the neck wrap portion extends around the user's neck in a generally horizontal plane when the neck wrap portion is configured around the user's neck and the user is in the upright standing position;
wherein each of the elongated members has an elongated member length of at least fifty centimeters;
wherein each of the elongated member lengths is longer than a width of the neck wrap portion; and
wherein the weight posts are configured on distal ends of the elongated members and are offset vertically down from the neck wrap portion.

2. The weight lifting apparatus of claim 1, wherein the weight lifting bar consists essentially of a single integral bar.

3. The weight lifting apparatus of claim 1, further comprising handles.

4. The weight lifting apparatus of claim 3, wherein the weight posts are configured as the handles.

5. The weight lifting apparatus of claim 3, wherein the handles are configured to attach to the weight posts.

6. The weight lifting apparatus of claim 5, wherein the handles are collar type handles.

7. The weight lifting apparatus of claim 6, wherein the collar type handles comprise a locking feature.

8. The weight lifting apparatus of claim 3, wherein the handles are configured inside of and essentially perpendicular to the weight posts.

9. The weight lifting apparatus of claim 8, wherein the handles are back facing handles.

10. The weight lifting apparatus of claim 1, further comprising a padding sleeve over at least the neck wrap portion.

11. The weight lifting apparatus of claim 10, wherein the padding sleeve extends down a substantial portion of the elongated members.

* * * * *